US008577050B2

(12) United States Patent
Margolis et al.

(10) Patent No.: US 8,577,050 B2
(45) Date of Patent: Nov. 5, 2013

(54) CALIBRATION OF AUDIOMETRIC BONE CONDUCTION VIBRATORS

(75) Inventors: Robert H. Margolis, Arden Hills, MN (US); George Saly, Edina, MN (US); Jonathan D. Birck, Portland, OR (US)

(73) Assignee: Audiology Incorporated, Arden Hills, MN (US)

( * ) Notice: Subject to any disclaimer, the term of this patent is extended or adjusted under 35 U.S.C. 154(b) by 31 days.

(21) Appl. No.: 13/370,050

(22) Filed: Feb. 9, 2012

(65) Prior Publication Data

US 2013/0039520 A1 Feb. 14, 2013

Related U.S. Application Data

(60) Provisional application No. 61/440,988, filed on Feb. 9, 2011.

(51) Int. Cl.
*H04R 25/00* (2006.01)

(52) U.S. Cl.
USPC ..... 381/60; 381/326

(58) Field of Classification Search
USPC ..... 381/60, 151, 326, 380, 429; 600/25; 607/55–57
See application file for complete search history.

(56) References Cited

U.S. PATENT DOCUMENTS 3,019,307 A 1/1962 Weiss
5,771,298 A 6/1998 Davis et al.

OTHER PUBLICATIONS

Rogers Corporation, High Performance Foams Division, "Poron 4701-50 Firm-Supported," 2000-2003, Publication #17-064, 2 pages.
Brüel & Kjaer, "4930 Artificial Mastoid," printed on Jan. 30, 2011 from http://bksv.com/products/transducersconditioning/acoustictransducers/couplers/4930.aspx, 1 page.
Larson Davis, "AMC 493 Artificial Mastoid Manual," 2002, 31 pages.
Kimmetrics, "Radio Ear Supplies," printed on Nov. 23, 2010 from http://www.kimmetrics.com/radio%20ear.htm, 2 pages.
"AUDit™ & System 824," retrieved from http://www.larsondavis.com/Downloads/AUDit-824_Data_Sheet.pdf, Jun. 2009, 4 pages.
"Audiometer CAL System," retrieved from http://www.larsondavis.com/AudioMeterCalSsytem.htm, Jun. 22, 2009, 1 page.

*Primary Examiner* — Curtis Kuntz
*Assistant Examiner* — Joshua Kaufman
(74) *Attorney, Agent, or Firm* — Fredrikson & Byron, PA

(57) ABSTRACT

Embodiments provide improved bone conduction calibration. In one embodiment a bone conduction vibrator coupling member is provided with opposing surfaces configured to contact the housing of an earphone coupler about the opening of the housing and support the housing of a bone conduction vibrator above the opening of the earphone coupler housing. The coupling member has an inner wall defining an aperture extending through the coupling member that is configured to receive the vibrating member of the bone conduction vibrator and provide the vibrating member with access to the cavity of the earphone coupler. A calibration system includes a bone conduction vibrator coupling member positioned upon an earphone coupler. Methods for calibrating a bone conduction vibrator using such a calibration system are also provided.

20 Claims, 8 Drawing Sheets

CALIBRATION OF AUDIOMETRIC BONE CONDUCTION VIBRATORS

CROSS-REFERENCES

This application claims the benefit of U.S. Provisional Application No. 61/440,988, filed Feb. 9, 2011, the content of which is hereby incorporated by reference in its entirety.

STATEMENT REGARDING FEDERALLY SPONSORED RESEARCH OR DEVELOPMENT

This invention was made with government support under grant no. R42 DC007773 and grant no. RC3 DC010986, both awarded by the National Institutes of Health. The Government has certain rights in the invention.

BACKGROUND

Hearing tests are performed by presenting acoustic signals to a listener and asking the listener to indicate if the sound was audible. The sound level of the signal is varied to find the lowest levels that can be detected. Signals are typically presented by a transducer such as an earphone, a loudspeaker, or a bone conduction vibrator. The audiometer and the transducer used to present the signals are normally calibrated to ensure accurate and reliable measurements. For an acoustic transducer such as an earphone or a loudspeaker, calibration is usually performed with a microphone that receives the acoustic signal from the transducer and a sound level meter that is configured to receive and measure the signal from the microphone. A bone conduction transducer (also referred to as a bone conduction vibrator) is usually calibrated by converting the vibrations of the bone conduction vibrator into a measurable electrical signal.

One method of calibrating a bone conduction vibrator is to couple the vibrator to an artificial mastoid (e.g., Bruel & Kjaer Type 4930). The artificial mastoid is designed to mimic the mechanical impedance of the human head. The bone conduction vibrator is coupled to the artificial mastoid with one or more weights that provide a standard coupling force. The artificial mastoid transduces the mechanical vibration of the bone conduction vibrator to an electrical signal that is input to a sound level meter, which measures the level of the electrical signal. The measured voltage can then be expressed as the force level delivered by the vibrator. The American (ANSI S3.6-2004) and international (IEC 389.3-1994) audiometer standards provide standard reference equivalent threshold force levels (RETFL) and the bone vibrator and connected audiometer are calibrated so that the output of the bone vibrator is equal to the RETFL when the audiometer signal level control is set to 0 dB.

Another method of calibrating a bone conduction vibrator involves the use of an artificial mastoid simulator (e.g., Larson Davis AMC493). The bone conduction vibrator is coupled to the simulator in the same fashion as that used when calibrating with the artificial mastoid. The simulator transduces the vibratory force produced by the bone conduction vibrator into an acoustic signal that is measured by a microphone coupled to a sound level meter. The frequency responses of the microphone and the simulator are initially calibrated in accordance with empirically gathered data so that relationship between the acoustic sound pressure level produced by the simulator and the force level produced by the vibrator is known at each test frequency. This allows the audiometer and bone vibrator to be calibrated such that the output of the bone vibrator is equal to the RETFL when the audiometer signal level control is set for 0 dB.

SUMMARY

According to one aspect of the invention, a bone conduction vibrator calibration system is provided for calibrating a bone conduction vibrator. The system includes an earphone coupler and a coupling member. The earphone coupler includes a housing defining a cavity and an opening providing access to the cavity and a microphone for sensing sound pressure levels within the cavity and generating a corresponding electrical signal. The coupling member is positioned about the opening of the earphone coupler housing. The coupling member comprises a first surface in contact with the housing of the earphone coupler, a second surface configured to support the housing of a bone conduction vibrator above the opening of the earphone coupler housing and an inner wall. The inner wall defines an aperture that extends through the coupling member and is configured to receive a vibrating member of the bone conduction vibrator.

According to another aspect of the invention, a coupling member is provided for coupling a bone conduction vibrator with an earphone coupler. The bone conduction vibrator has a housing and a vibrating member and the earphone coupler has a housing defining a cavity and an opening providing access to the cavity. The coupling member has a first surface, a second surface, and an inner wall. The first surface is configured to contact the housing of the earphone coupler about the opening of the housing and the second surface is configured to support the housing of the bone conduction vibrator above the opening of the earphone coupler housing. The inner wall defines an aperture extending through the coupling member. The aperture is configured to receive the vibrating member of the bone conduction vibrator and provides the vibrating member with access to the cavity of the earphone coupler.

According to another aspect of the invention, a method of calibrating a bone conduction vibrator is provided. The method includes providing an earphone coupler that has a housing defining a cavity and an opening providing access to the cavity. The coupler also has a microphone for sensing sound pressure levels within the cavity. The method further includes positioning a coupling member on the earphone coupler about the opening of the earphone coupler housing. The coupling member includes an inner wall that defines an aperture extending through the coupling member. The method also includes positioning a bone conduction vibrator on the coupling member opposite from the earphone coupler with a vibrating member of the bone conduction vibrator disposed within the aperture of the coupling member in communication with the cavity of the earphone coupler. The method also includes actuating the bone conduction vibrator and sensing sound pressure levels generated by the bone conduction vibrator within the earphone coupler cavity with the microphone to determine if the bone conduction vibrator is generating desired vibrational force levels.

These and various other features and advantages will be apparent from a reading of the following detailed description.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION OF THE PREFERRED EMBODIMENTS

Figure 1A:
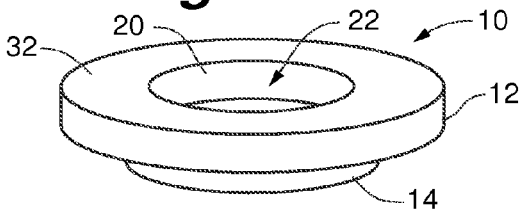
FIG. 1A is a perspective view of a coupling member according to an embodiment of the invention.
Figure 1B:
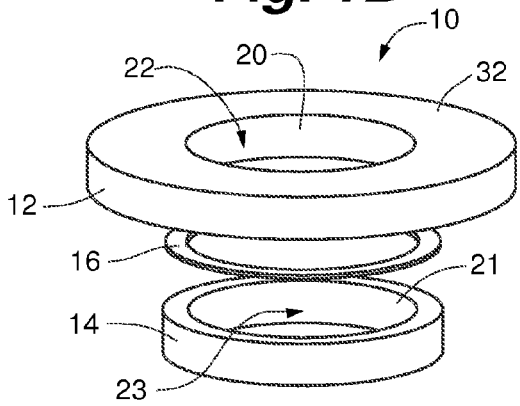
FIG. 1B is a perspective exploded assembly view of the coupling member of FIG. 1.
Figure 1C:
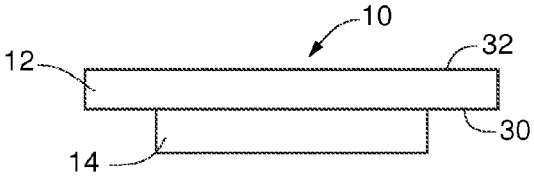
FIGS. 1C and 1D are side and bottom views, respectively, of the coupling member of FIG. 1.
Figure 1D:
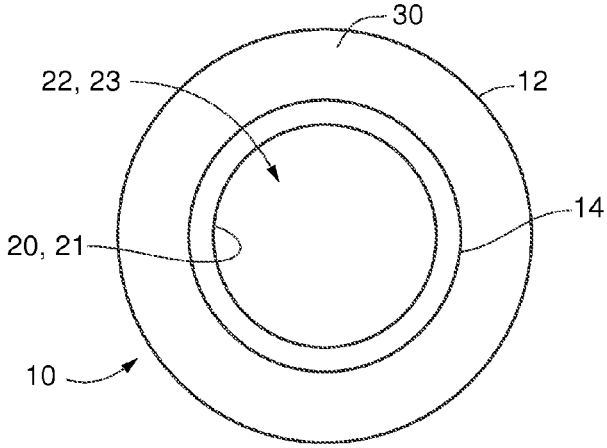
Figure 2A:
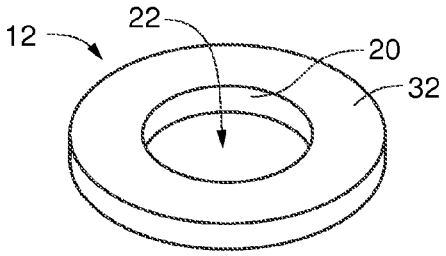
FIGS. 2A and 2B are perspective and top views, respectively, of a top portion of the coupling member of FIG. 1.
Figure 2B:
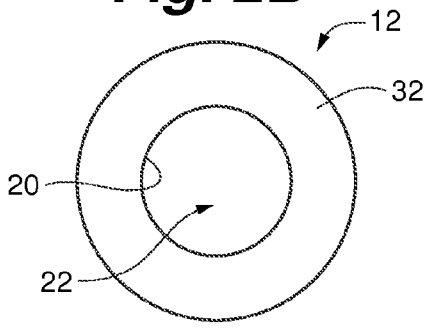
Figure 3A:
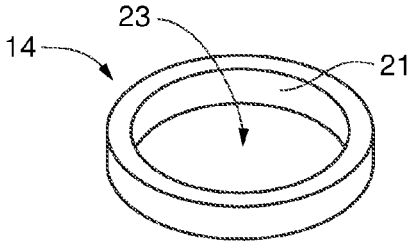
FIGS. 3A and 3B are perspective and top views, respectively, of a bottom portion of the coupling member of FIG. 1.
Figure 3B:
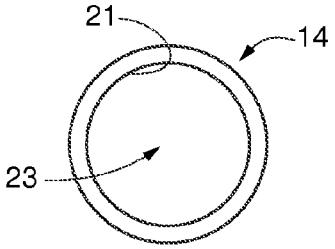

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

FIGS. 1A-1D provide various views of a coupling member 10 according to an embodiment of the invention. The coupling member 10 is configured (e.g., size, shape, material selection, etc.) to couple a bone conduction vibrator (e.g., a transducer) with an earphone coupler for calibrating the force levels generated by the bone conduction vibrator. The term "couple" is used herein to refer to the act of joining or providing an interface and does not necessarily require positive attachment between the coupling member 10 and the earphone coupler and/or bone conduction vibrator. As an example, coupling a bone conduction vibrator with an earphone coupler can involve simply providing an intermediate member that is positioned between the vibrator and coupler but not fixed or fastened (e.g., with a clamp, adhesive, screw, etc.) to the vibrator or coupler. As another example, in some cases coupling a bone conduction vibrator with an earphone coupler can involve both positioning a member between a vibrator and coupler and attaching or fastening the member to the vibrator and/or coupler. However, as used herein, the term coupling does not require the use of clamps, adhesive, or other types of fastening mechanisms unless otherwise stated.

The coupling member 10 provides several advantages over conventional bone conduction calibration schemes. For example, the coupling member 10 can in some cases be used with a standard earphone coupler to calibrate a bone conduction vibrator. In particular, the coupling member 10 enables calibration of a bone conduction vibrator without directly simulating the impedance of the mastoid bone. In contrast, traditional calibration systems including an artificial mastoid (e.g., Bruel & Kjaer Type 4930) or an artificial mastoid simulator (e.g., Larson Davis AMC493) seek to accurately reproduce the impedance characteristics of the average human mastoid bone and the effect of the impedance upon vibrations from the bone conduction transducer. The inventors have discovered that modeling the mastoid impedance is not always necessary for accurate bone conduction calibration. This follows from the discovery that there is a relationship between the vibratory force delivered when the vibrator is placed on the head during hearing testing and the acoustic radiation from the vibrator. This allows accurate determination of the level of vibratory force delivered to the head from a measurement of the acoustic radiation from the vibrator, made in a controlled acoustic setting.

Accordingly, the inventors describe herein embodiments that allow accurate calibration of multiple bone conduction vibrators without simulating the mastoid impedance for each calibration. Certain embodiments of the invention thus provide a simpler and less expensive manner of calibrating a bone conduction vibrator, especially when contrasted with currently available bone conduction calibration systems.

As shown in FIGS. 1A-1D, the coupling member 10 of the illustrated embodiment includes a top portion 12 and a bottom portion 14, which are attached together with an adhesive strip 16. Other types of fasteners may also be used. In addition, certain embodiments can provide a one-piece coupling member having an integral top portion and bottom portion. As also shown in FIGS. 2A-3B, the top portion 12 is formed as a generally flat, planar ring or washer and the bottom portion 14 is formed as a ring having a smaller radial width than radial width of the top portion 12. Both the top portion and the bottom portion have inner walls 20, 21 that define apertures 22, 23 extending through the top and bottom portions, respectively. In some embodiments the inner walls 20, 21 of the top and bottom portions combine to provide the coupling member 10 with a single inner wall defining an aperture extending through the coupling member 10. In some cases the inner walls 20, 21 are optionally aligned to form a substantially smooth and continuous inner wall for the coupling member 10.

The top portion 12 includes a first surface 30 and a second surface 32. The first surface is configured to contact and be placed upon an earphone coupler about an opening to a cavity within the earphone coupler. Thus, the first surface 30 preferably matches the corresponding, mating surface of the earphone coupler. For example, in the illustrated embodiment the first surface 30 has a smooth planar contour formed to easily rest upon a corresponding smooth rim of the earphone coupler surrounding the cavity opening. The second surface 32 is configured to contact and support the housing of a bone conduction vibrator above the opening of the earphone coupler cavity. In some cases the second surface 32 has a generally planar, smooth contour to provide a flat surface for supporting the bone conduction vibrator housing.

According to some embodiments, the bottom portion 14 is configured to be at least partially received within the opening of the earphone coupler while the top portion 12 is supported by an outer surface of the earphone coupler. For example, a testing technician may manually insert the bottom portion 14 into the opening and cavity of the earphone coupler. In this way the bottom portion 14 can stabilize the coupling member 10 about the opening of the earphone coupler and limit lateral movement of the coupling member 10 upon the earphone coupler. The bottom portion 14 is an optional feature that may not be included in all embodiments of the coupling member. In certain embodiments, other stabilizing features (or none at all) may be provided to limit movement of the coupling member upon the earphone coupler.

In certain embodiments the top and/or bottom portions 12, 14 of the coupling member are formed from a compressible or slightly compressible material. According to an embodiment of the invention, the top and bottom portions 12, 14 are formed from a polyurethane foam. One example of a suitable polyurethane foam available from Rogers Corporation is the PORON 4701-50 Firm urethane foam having a clear polyester film supporting material. The firm, but slightly compressible nature of the PORON foam can provide an optional, substantially complete acoustical seal between the bone conduction vibrator housing, the coupling member 10 and the housing of the earphone coupler, when the bone conduction vibrator is weighted down upon the coupling member.

The coupling member 10 illustrated in FIGS. 1A-3B has a circular, washer-like configuration. The inventors have found such a configuration to be useful in conjunction with a an artificial ear coupler according to the international standard IEC 60318-1. Referring to FIG. 1C, according to one embodiment the coupling member 10 has an overall thickness of about 0.25 inches, the top portion has a diameter of about 1.25 inches, the bottom portion has a diameter of about 0.82 inches, and the apertures of the first and second portions have a diameter of about 0.67 inches. Of course this is just one example, and it is contemplated that the size and shape of a coupling member will be configured to match the earphone coupler with which it is being used.

Figure 4:
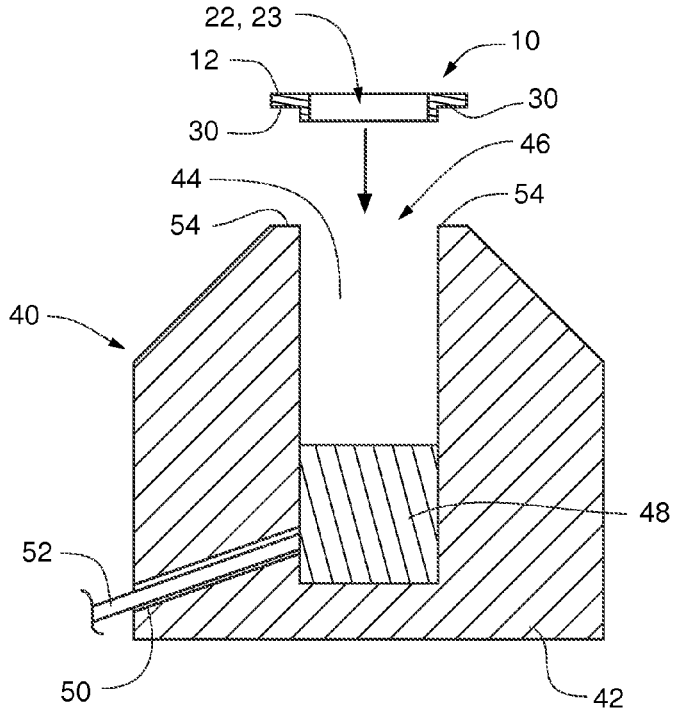
FIG. 4 is a cross-sectional view illustrating installation of a coupling member on an earphone coupler according to an embodiment of the invention.

Turning to FIG. 4, a cross-sectional view of the coupling member 10 and an earphone coupler 40 are shown. The earphone coupler 40 is generally formed from a housing 42 that defines a cavity 44 within the coupler. The housing 42 also defines an opening 46 in communication with and providing access to the cavity 44. The earphone coupler 40 also includes a microphone 48 positioned within the cavity 44, and a passage 50 that allows the microphone cord 52 to extend through the coupler housing.

As is well known, earphone couplers (also sometimes referred to as air conduction couplers) such as the coupler 40 illustrated in FIG. 4, are generally capable of measuring sound pressure levels emitted by an earphone placed over the opening 46. The microphone 48 converts the sound pressure levels emanating through the cavity 44 into an electrical signal, which can then be output through the microphone cord 52 for analysis. To calibrate an earphone, the earphone is coupled to an audiometer and placed on the coupler 40 over the cavity opening 46. During calibration, the audiometer generates a series of test signals at particular test frequencies and the microphone 48 detects the resulting sound pressure levels in the cavity 44 emitted by the earphone. The electrical output from the microphone 48 is usually measured with a sound level meter, which indicates the sound pressure level that a real listener's eardrum would experience from the same test signal and earphone during a hearing test. The signal level of the audiometer can then be adjusted until the output of the earphone is equal to a standard reference equivalent sound pressure level (RESPL) when the audiometer signal level control is set to 0 dB. In some cases this process may be managed by a software program running on a computer coupled to the sound level meter and/or the audiometer.

Embodiments of the invention advantageously utilize an air conduction coupler for calibrating a bone conduction transducer or vibrator. Such earphone couplers are generally less expensive and more commonplace among standard audiometric equipment than specialized bone conduction calibrators such as artificial mastoids or mastoid simulators. It is contemplated that different embodiments may incorporate a wide variety of earphone couplers, and the scope of the invention is not limited in this regard. Some examples of possible coupler configurations include, without limitation, an artificial ear according to international standard IEC 60318-1 and a standard reference coupler according to the international standard IEC 60318-3 or ANSI 53.7-1995 (R 2003), American National Standard Method for Coupler Calibration of Earphones (NBS 9A).

Figure 5:
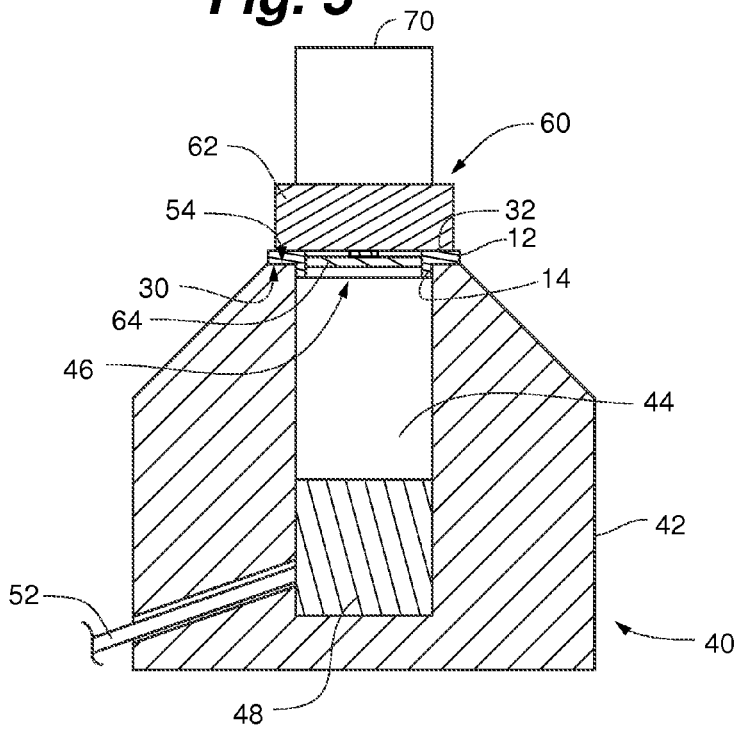
FIG. 5 is a cross-sectional view of a bone conduction transducer positioned upon a coupling member and earphone coupler according to an embodiment of the invention.

Referring to FIGS. 4 and 5, the coupling member 10 is positioned about the opening 46 of the coupler 40. In certain cases the coupler 40 includes a rim portion 54 that surrounds and defines the opening 46, and also provides a mating surface upon which the coupling member 10 is placed. For example, the first surface 30 of the coupling member 10 may be configured to contact and rest upon the rim portion 54 of coupler 40. In certain embodiments the coupling member 10 includes the bottom/annular portion 14, which fits within the opening 46 to limit lateral movement of the coupling member relative to the earphone coupler. Of course other structures may also or alternatively be provided to limit movement of the coupling member 10.

Turning to FIG. 5, a bone conduction vibrator 60 is shown positioned above the opening 46 of the earphone coupler 40, with the coupling member 10 providing an interface between the two components and a weight 70 providing a coupling force. Because the characteristics of the weight 70 and the coupling member 10 can affect performance of the coupling member, a standardized weight/coupling member set (e.g., as part of a kit) can be used to increase performance consistency across multiple uses if desired.

As described above, the first surface 30 of the coupling member is supported by the rim portion 54 of the earphone coupler 40. The second surface 32 of the coupling member 10 is configured to receive and support the housing 62 of the bone conduction vibrator 60 (e.g., along the bottom surface of the transducer housing 62). As shown, the aperture of the coupling member 10 (e.g., comprising the apertures 22, 23 of the top and bottom portions in this case) is configured to receive the vibrating member 64 of the bone conduction transducer 60. The coupling member 10 thus supports the bone conduction transducer upon the earphone coupler, while the coupling member aperture provides a passage between the transducer and the cavity 44 of the earphone coupler 40. The passage provides the vibrating member 64 with access to the cavity 44 of the earphone coupler 40, allowing the vibrating member 64 to move up and down in relation to the coupling member aperture and the cavity 44.

As the vibrating member 64 actuates within the coupling member aperture, the opening 46 and/or the cavity 44, it generates an acoustic vibration (i.e., a sound pressure wave) that propagates into the cavity 44. The level of the acoustic vibration/sound pressure wave is proportional to the force level delivered by the vibrator 60 when the vibrator is coupled to a human head (e.g., adjacent the mastoid bone). The microphone 48 senses the sound pressure level within the cavity and generates a corresponding electrical signal. The signal can then be analyzed to determine the corresponding force levels delivered by the vibrator 60. The cooperation of the coupling member 10 and the earphone coupler 40 thus provides a calibration system that senses the acoustic vibrations of the bone conduction vibrator, converts them to an electrical signal, and outputs the electrical signal for analysis and determination of the corresponding force levels of the bone conduction vibrator.

Figure 6:
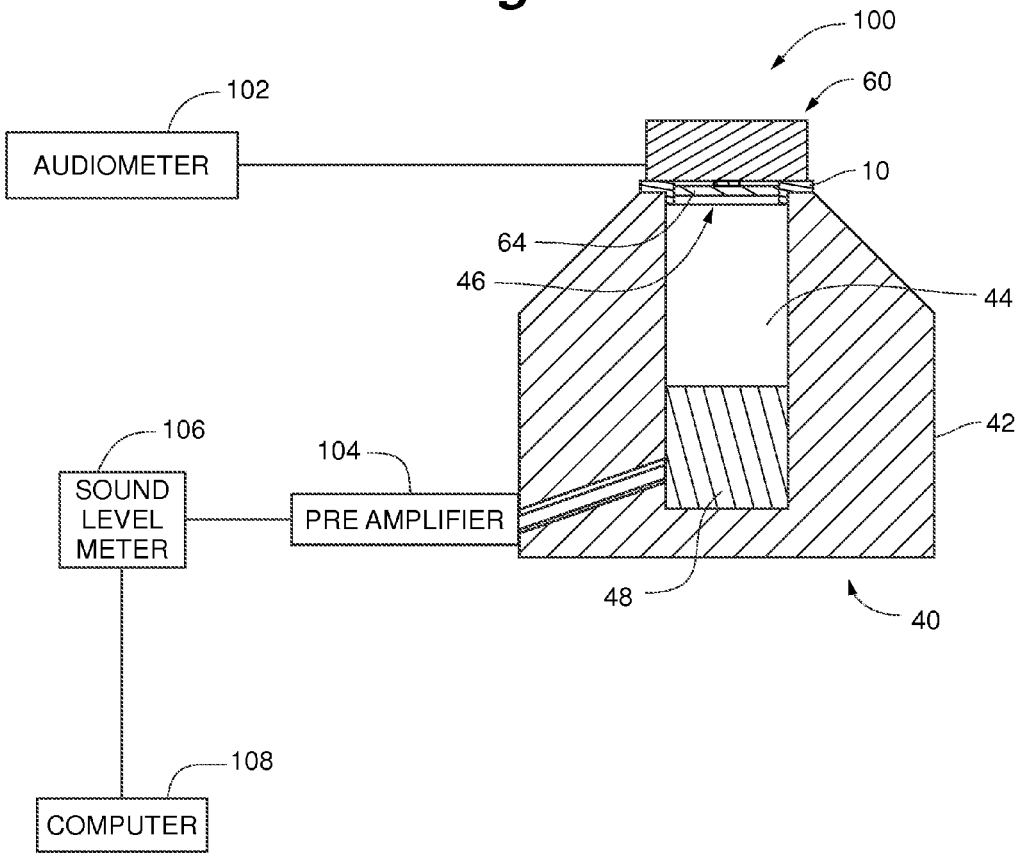
FIG. 6 is a block diagram of a bone conduction calibration system according to an embodiment of the invention.

FIG. 6 is a block diagram of another bone conduction calibration system 100 according to an embodiment of the invention. The calibration system 100 includes the earphone coupler 40 and coupling member 10 discussed above, with a bone conduction transducer 60 positioned above the opening 46 and the cavity 44 of the earphone coupler 40. An audiometer 102 coupled to the bone conduction transducer 60 generates and transmits one or more test signals to the bone conduction transducer, causing the vibrating member 64 of the transducer to vibrate and generate corresponding acoustic vibrations/sound pressure waves within the cavity 44. The microphone 48 of the coupler 40 senses the pressure waves caused by the vibrating member and generates a corresponding electrical signal which is output first to a preamplifier 104, and then to a sound level meter 106, which measures the levels of the acoustic vibrations. According to some embodiments, the measurements are then transmitted to a computer 108, which converts the signal measurements to force levels using a predetermined conversion relationship or conversion table. The output of the audiometer 102 can then be calibrated or adjusted so that the output of the bone vibrator is equal to the RETFL when the audiometer signal level control is set for 0 dB.

In certain embodiments the conversion relationship/table between the sound pressure levels measured by the sound level meter 106 and the force levels of the bone conduction transducer 60 can be predetermined and then stored within memory in the computer 108 and/or sound level meter 106 for future use in converting sound pressure levels to force levels. For example, an artificial mastoid or an artificial mastoid simulator, such as one of those described above, can be used to initially determine the sound pressure-force level conversion relationship for a particular type of bone conduction transducer. While this embodiment still requires the initial use of an artificial mastoid and/or mastoid simulator, the mastoid/simulator is only needed for an initial characterization of a bone conduction vibrator and determination of the appropriate conversion relationship. Thus, conversion relationships or tables can be determined for particular bone conduction vibrators during development and/or manufacture (e.g., in the factory), and then incorporated into calibration software that can be packaged and sold with individual coupling members, calibration kits, etc.

For example, in certain embodiments conversion relationships or tables may be determined and then coded into computer-executable instructions and included with computer-executable instructions for calibrating a bone conduction transducer, all stored in a computer-readable storage medium, provided in the form of semiconductor devices, optical disks, magnetic media, and/or other tangible media. Although not shown in FIG. 6, in certain cases the computer 108 may be coupled with the audiometer 102. In such cases the computer 108 may be programmed to automatically adjust the signal output levels of the audiometer in order to provide calibrated force levels for the bone conduction transducer. Alternatively, the audiometer 102 may be coupled directly to the sound level meter 106, the preamplifier 104, or the earphone coupler 40 and may itself include a programmable processor configured to carry out a calibration process based on the sensed acoustic vibrations. US Publication Application No. 2011/0009770A1 provides some examples of audiometric testing and calibration devices and methods and is incorporated herein by reference in its entirety.

Certain embodiments of the invention provide one or more methods of calibrating a bone conduction transducer using an earphone coupler and a coupling member such as one of those described above. According to certain embodiments, a calibration method includes at least the following steps:

- Position a coupling member on an earphone coupler about the opening of the earphone coupler housing;
- Position a bone conduction vibrator on the coupling member opposite from the earphone coupler with a vibrating member of the bone conduction vibrator disposed within an aperture of the coupling member in communication with a cavity of the earphone coupler;
- Actuate the bone conduction vibrator to generate acoustic vibration sound pressure waves within the earphone coupler cavity;
- Sense the sound pressure levels of the acoustic vibrations; and
- Determine a force level for the bone conduction vibrator corresponding to the sensed sound pressure levels.

In certain embodiments, a method may include providing an earphone coupler, such as one of those described herein. For example, the earphone coupler may have a housing that defines a cavity and a microphone within the cavity to sense sound pressure levels. The microphone can thus generate an electrical signal corresponding to the acoustic vibrations and the level of the electrical signal can be measured to determine the corresponding force level. In some embodiments an audiometer may generate the test signal that is sent to the bone vibrator. In addition, a method can include an adjustment feedback loop that includes comparing the determined force level to a desired force level for the particular test signal and then adjusting the output of the audiometer based on differences between the determined and the desired force levels.

One embodiment of the invention provides a method of calibrating a bone conduction vibrator. The method includes measuring acoustic radiation from a bone conduction vibrator and determining a vibratory force delivered by the bone conduction vibrator that corresponds to the measured acoustic radiation. For example, the method may use a known conversion relationship between the vibratory force delivered when the vibrator is placed on the head during hearing testing and the acoustic radiation from the vibrator. In some embodiments a device, such as the coupling member 10 described above can facilitate determining the vibratory force associated with the acoustic radiation. For example, in some cases a device may provide a substantially sealed transition between a bone vibrator and an earphone coupler so that acoustic leaks between the vibrator and coupler are reduced, minimized, and/or eliminated.

EXAMPLE I

Figure 7:
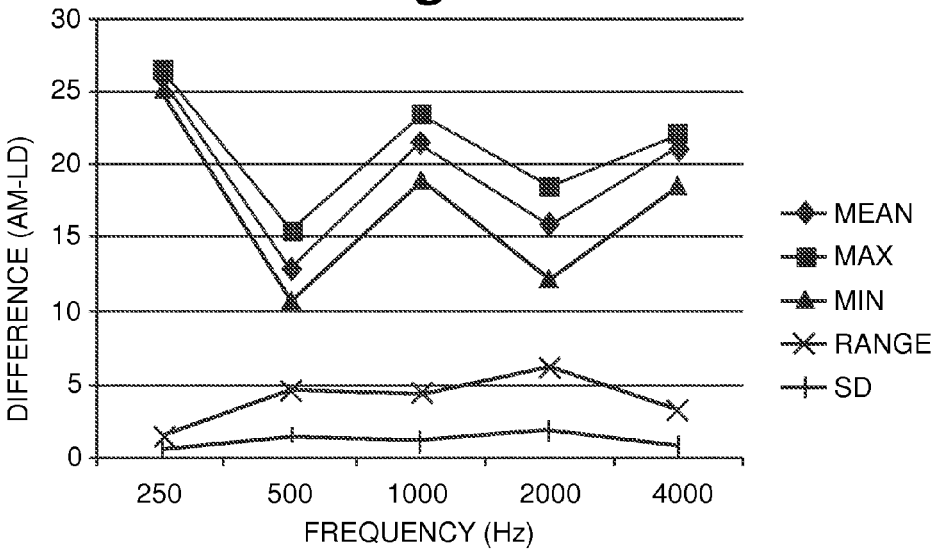
FIGS. 7 and 8 are charts illustrating performance differences between an embodiment of the invention and an artificial mastoid simulator.
Figure 8:
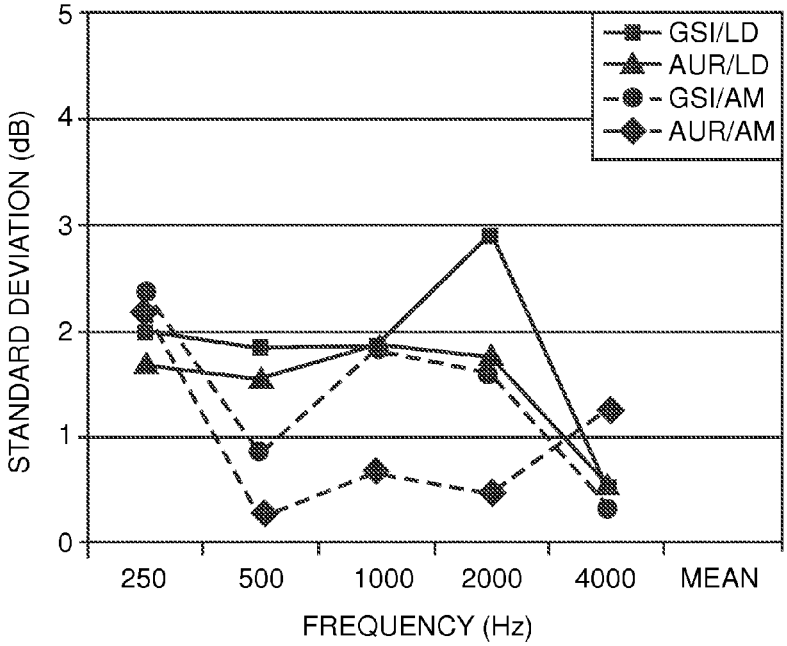

FIGS. 7 and 8 illustrate performance differences between an embodiment of the invention including a coupling member such as the coupling member 10 shown in FIGS. 1A-1D and a Larson Davis artificial mastoid simulator, Model AMC493. Separate measurements were made using a 60318-1 artificial ear coupler and a Radioear B71 bone conduction vibrator with two different audiometers (Grason Stadler GSI 61 and Madsen Aurical). Measurements were made at five test frequencies repeated on five different dates with both the exemplary coupling member according to an embodiment of the invention and the Larson Davis AMC493 simulator. FIG. 7 (top) shows the average difference (averaged over the two audiometers and five dates), along with the maximum and minimum differences between levels measured with the two bone conduction coupling devices. The levels measured with the inventive coupling member were always higher than those measured with the Larson Davis AMC493 simulator, presumably due to the losses in the transduction process of the AMC493 simulator. Accordingly, the inventive coupling member provides improved performance over the AMC493 simulator because it allows the measurement of lower stimulus levels. The two bottom curves of FIG. 7 show the standard deviations of the differences over the five dates and the range. These results indicate that the differences between values measured with the two devices are stable over time.

FIG. 8 illustrates variances associated with the exemplary coupling member (AM) and the AMC493 simulator (LD) for each of the two audiometers, the Grason Stadler GSI-61 (GSI) and the Madsen Aurical (Aur). Each point is the standard deviation of measures taken over five days. For both audiometers, the variance associated with the exemplary coupling member is lower than the variance associated with the AMC493 simulator, indicating that measurements made with the exemplary coupling member are more repeatable than measurements made with the AMC493 simulator.

EXAMPLE II

FIGS. 9-13 illustrate performance differences between an embodiment of the invention including a coupling member such as the coupling member 10 shown in FIGS. 1A-1D and a Bruel & Kjaer 4930 artificial mastoid.

Sound pressure levels were measured with the arrangement similar to the arrangement in FIGS. 4 and 5 for several audiometers and bone vibrators. Measurements made with the coupling member were compared to results obtained with the artificial mastoid 4930. Bruel & Kjaer 4930 that was recently calibrated. The measuring instrument was a commercial sound level meter (Larson Davis System 824) with 0.5 in. condenser microphone (Larson Davis model 2559). The sound level meter was calibrated with a commercial device designed for calibration of sound-level meters (Bruel & Kjaer 4230). The calibrator was cross-checked with a second sound level meter which was calibrated with its own calibrator. All measurements were made in a double-wall sound booth. Sound pressure levels for sinusoidal signals were measured in ⅓ octave filters.

The variability of measurements made with the coupling member was assessed for measurements made (a) with five coupling members, (b) on five separate days, (c) for five audiometers each with their own bone vibrator, and (d) for five audiometers with the same bone vibrator. In addition, the linearity of measured levels for varying input levels was observed and reference-equivalent threshold sound pressure levels for bone conduction stimuli were derived for the coupling member.

Figure 9:
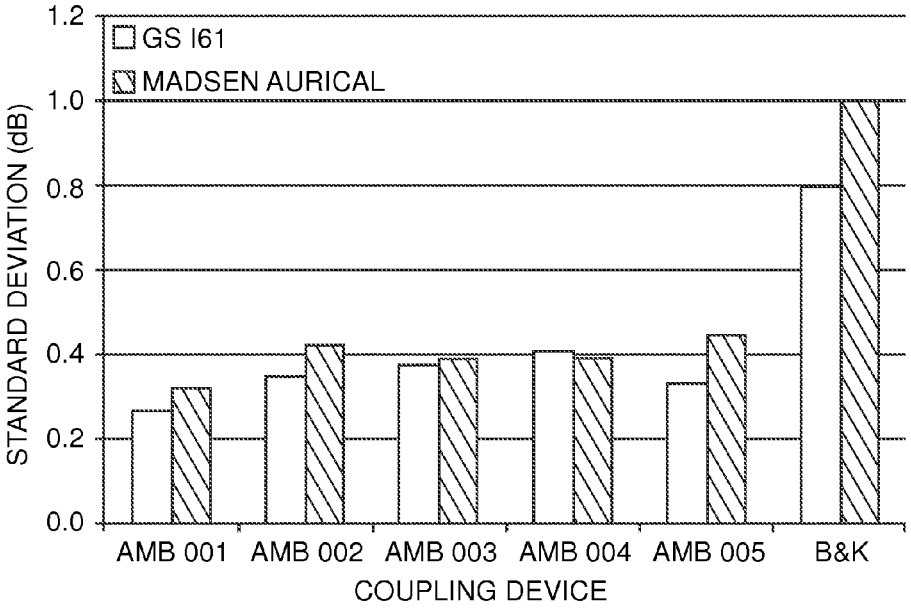
FIGS. 9-13 are charts illustrating performance differences between an embodiment of the invention and an artificial mastoid.

FIG. 9 shows variability associated with the five measurement days for the coupling members (denoted "AMB 001", "AMB 002", and so on) and the B&K 4930. Artificial Mastoid (denoted "B&K") for two audiometers. Standard deviations for the coupling members, averaged across the nine measurement frequencies, ranged from 0.27 to 0.44 dB. Average standard deviations for measurements made with the B&K Artificial mastoid were 0.80 and 1.00 dB for the Grason Stadler GSI-61 audiometer and the Madsen Aurical audiometer, respectively.

Figure 10:
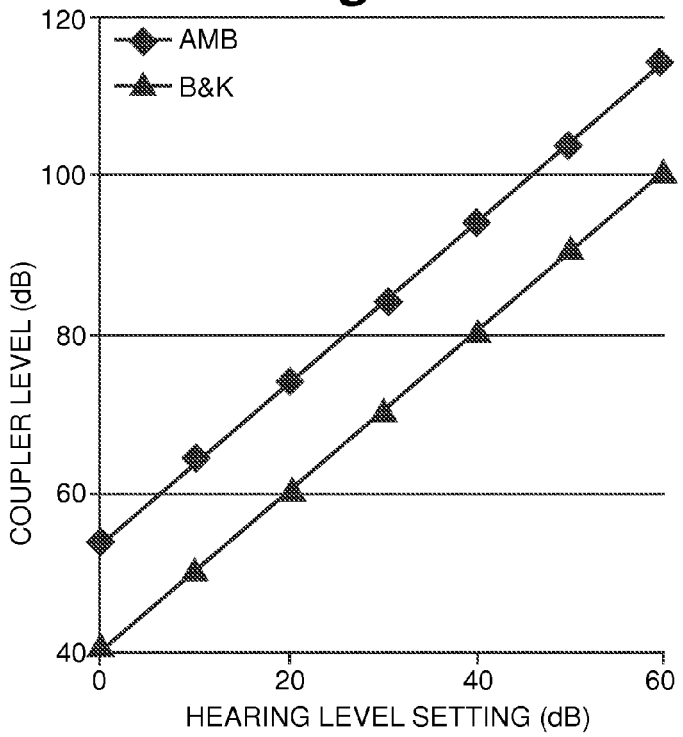

FIG. 10 shows linearity measurements for output levels measured with the coupling member (AMB) and the B&K artificial mastoid (B&K). Signals were delivered by a clinical audiometer (Madsen Aurical) to a bone vibrator (Radioear B-71) coupled to the sound level meter with the two coupling devices for output levels ranging from 0-60 dB HL. The results indicate a high degree of linearity with both coupling devices.

Figure 11:
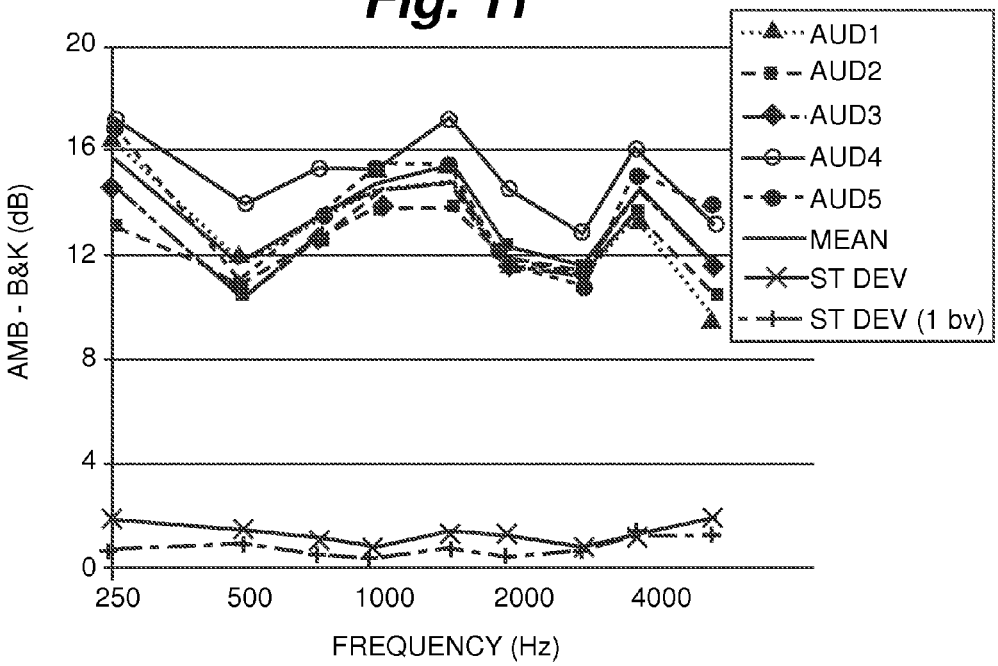
Figure 12:
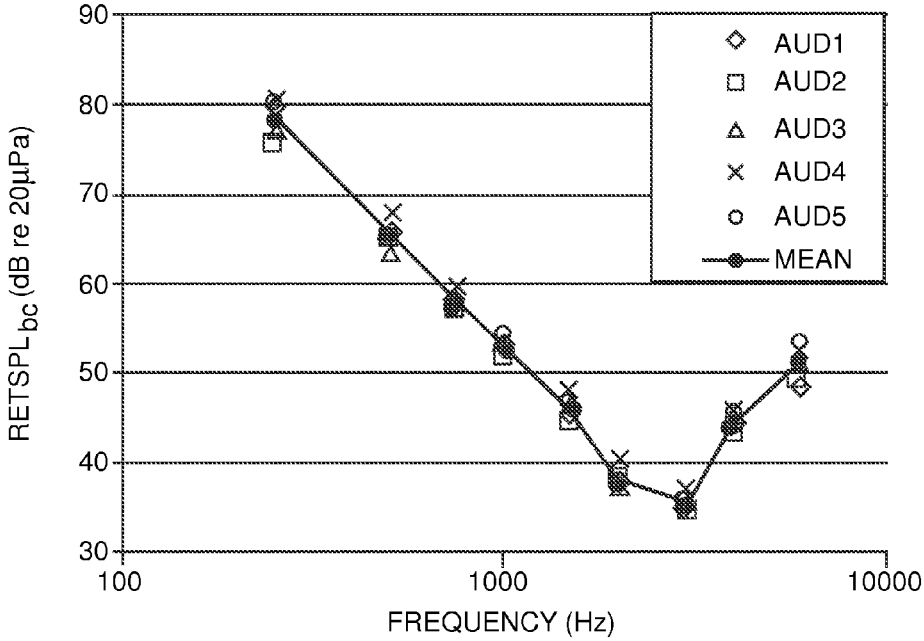

FIG. 11 shows results for five audiometers (four Madsen Coneras and one Madsen Aurical) each with their own Radioear B71 bone vibrator. The Conera audiometers were located in the University of Minnesota Hospital Audiology Clinic. The Madsen Aurical is used in the Audiology Research Laboratory in the University of Minnesota Hospital. Although all audiometers had been calibrated recently, there are likely to be small calibration differences that will affect the measurements made with the coupling member. To control for the calibration variability, measurements are expressed relative to values obtained with the B&K 4930. Artificial Mastoid. Ideally there would be a fixed relationship between measurements made with the coupling member and those made with the artificial mastoid.

The data in FIG. 11 show a range of values that varied from mean+/−0.8 dB to mean+/−2.2 dB for the nine test frequencies. The average standard deviation across frequencies is 1.2 dB. Because these are difference values, the variance of the differences is equal to the sum of the variances of the two measurements that constitute the differences. The average standard deviation of 1.2 dB is roughly equal to the sum of the standard deviations for the coupling member and B&K 4930 measurements shown in FIG. 11. Because the B&K 4930 measurements have a larger standard deviation than the coupling member measurements, the variability of the B&K 4930 measurements dominates the variability of the differences.

Also shown in FIG. 11 are the average standard deviations for five audiometers each activating the same bone vibrator (see + symbols). This permits an examination of the extent to which the variance is associated with the vibrator as opposed to the audiometer. The standard deviations across frequency were smaller when one vibrator was used. The average standard deviation across all frequencies with one vibrator was 0.7 dB. The lower standard deviation when one vibrator was used suggests that a significant portion of the variance associated with multiple audiometers is attributable to the bone vibrator.

From the data in FIG. 11 and the reference equivalent threshold force levels from the audiometer standards (ANSI S3.6-2010; ISO 389.3-1994) it is possible to calculate reference equivalent threshold sound pressure levels ($RETSPL_{bc}$) for calibration of audiometers with Radioear B71 bone vibrators with the following conversion relationship:

$$RETSPL_{bc}=RETFL+D;$$

where RETFL is the reference equivalent threshold force level (dB re 1 μN) from the audiometer standards and D is the mean differences shown in FIG. 11 (solid line). That is, D is the numerical value of the difference between the sound pressure level (dB re 20 μPa) measured with the coupling member and the force level (dB re 1 μN) measured with the B&K 4930 Artificial Mastoid. $RETSPL_{bc}$ values were calculated for each of the five audiometers (see FIG. 12 and Table 1).

TABLE 1

| Frequency (Hz) | 250 | 500 | 750 | 1000 | 1500 | 2000 | 3000 | 4000 | 6000 |
|---|---|---|---|---|---|---|---|---|---|
| Mean $RETSPL_{bc}$ (dB re 20 μPa) | 78.6 | 65.4 | 57.9 | 52.9 | 46.2 | 38.2 | 35.4 | 44.4 | 51.0 |
| Standard Deviation | 1.8 | 1.4 | 1.1 | 0.7 | 1.3 | 1.2 | 0.8 | 1.1 | 1.8 |

Figure 13:
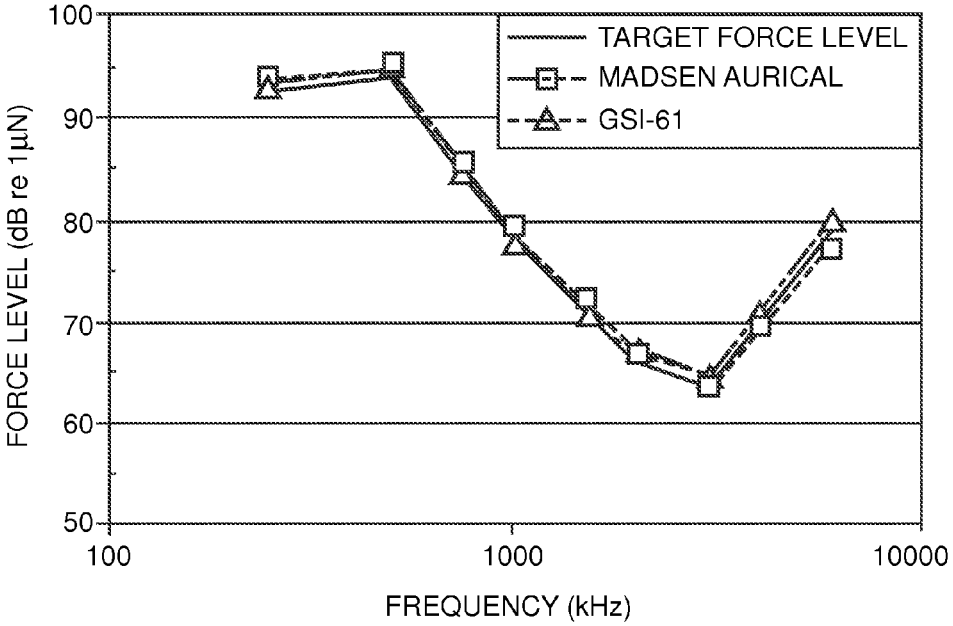

To validate the $RETSPL_{bc}$ values in Table I, two audiometers were calibrated with the coupling member to those values. The output levels were then measured with a B&K artificial mastoid to determine the accuracy of calibration. The results, indicated in FIG. 13, show that the audiometers calibrated with the coupling member were in calibration as determined by B&K 4930 measurements.

Thus, embodiments of the invention are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention and the scope of the appended claims.

What is claimed is:

1. A coupling member for coupling a bone conduction vibrator with an earphone coupler, the bone conduction vibrator comprising a housing and a vibrating member and the earphone coupler comprising a housing defining a cavity and an opening providing access to the cavity, the coupling member comprising:

a first surface configured to contact the housing of the earphone coupler about the opening of the housing;

a second surface configured to contact the housing of the bone conduction vibrator above the opening of the earphone coupler housing; and an inner wall defining an aperture extending through the coupling member, the aperture configured to receive the vibrating member of the bone conduction vibrator and provide the vibrating member with access to the cavity of the earphone coupler.

2. The coupling member of claim 1, wherein at least one of the first surface and the second surface comprises a smooth planar contour.

3. The coupling member of claim 1, further comprising a planar ring member comprising the first surface on a first side of the planar ring member and the second surface on an opposite second side of the planar ring member.

4. The coupling member of claim 3, wherein the planar ring member comprises an inner wall that forms at least part of the inner wall of the coupling member defining the aperture extending through the coupling member.

5. The coupling member of claim 1, further comprising a first portion configured to rest upon a rim of the earphone coupler housing and a second portion configured to be at least partially received within the opening of the earphone coupler.

6. The coupling member of claim 5, wherein the first portion comprises an inner wall and the second portion comprises an inner wall, wherein the first portion inner wall and the second portion inner wall form at least part of the inner wall of the coupling member defining the aperture extending through the coupling member.

7. The coupling member of claim 5, wherein the coupling member is configured to be positioned between the bone conduction vibrator and the earphone coupler without attaching to either the bone conduction vibrator or the earphone coupler.

8. The coupling member of claim 1, further comprising a stabilizing feature that limits lateral movement of the coupling member with respect to the earphone coupler.

9. The coupling member of claim 1, wherein the first surface and the second surface are configured to form at least part of a substantially complete acoustical seal between the bone conduction vibrator and the earphone coupler during calibration.

10. A kit comprising the coupling member of claim 1 and at least one weight configured to act upon the bone conduction vibrator to generate a desired coupling force.

11. A method of calibrating a bone conduction vibrator, comprising:

providing an earphone coupler comprising a housing defining a cavity and an opening providing access to the cavity and a microphone for sensing sound pressure levels within the cavity;

positioning a coupling member on the earphone coupler about the opening of the earphone coupler housing, the coupling member comprising an inner wall defining an aperture extending through the coupling member;

positioning a bone conduction vibrator on the coupling member opposite from the earphone coupler with a vibrating member of the bone conduction vibrator disposed within the aperture of the coupling member in communication with the cavity of the earphone coupler;

actuating the bone conduction vibrator; and sensing sound pressure levels generated by the bone conduction vibrator within the earphone coupler cavity with the microphone to determine if the bone conduction vibrator is generating desired vibrational force levels.

12. The method of claim 11, wherein positioning the coupling member on the earphone coupler comprises inserting a portion of the coupling member within the opening of the earphone coupler housing.

13. The method of claim 11, further comprising converting the sensed sound pressure levels to vibrational force levels using a conversion relationship based on a reference equivalent threshold sound pressure level.

14. The method of claim 13, wherein the conversion relationship is $$RETSPL_{bc}=RETFL+D, \text{ wherein}$$

$RETSPL_{bc}$ is the reference equivalent threshold sound pressure level,

RETFL is a reference equivalent threshold force level, and

D is the numerical value of a difference between a reference sound pressure level measured using the coupling member and a reference force level measured using a calibration device that models a mechanical impedance of a human head.

15. A bone conduction vibrator calibration system, comprising:

an earphone coupler comprising a housing defining a cavity and an opening providing access to the cavity and a microphone for sensing sound pressure levels within the cavity and generating a corresponding electrical signal; and a coupling member positioned about the opening of the earphone coupler housing, the coupling member comprising a first surface in contact with the housing of the earphone coupler, a second surface configured to support the housing of a bone conduction vibrator above the opening of the earphone coupler housing; and an inner wall defining an aperture extending through the coupling member, the aperture configured to receive a vibrating member of the bone conduction vibrator.

16. The calibration system of claim 15, wherein the coupling member comprises a stabilizing feature that limits lateral movement of the coupling member with respect to the earphone coupler.

17. The calibration system of claim 16, wherein at least a portion of the coupling member is received within the opening of the earphone coupler.

18. The calibration system of claim 15, wherein the first surface of the coupling member is configured to form a substantially complete acoustical seal between the coupling member and the earphone coupler during calibration and the second surface of the coupling member is configured to form a substantially complete acoustical seal between the coupling member and the housing of the bone conduction vibrator during calibration.

19. The calibration system of claim 15, wherein the coupling member comprises a polyurethane foam.

20. The calibration system of claim 15, further comprising at least one weight configured to act upon the bone conduction vibrator to generate a desired coupling force.

* * * * *